United States Patent [19]

Rudy

[11] 4,447,049

[45] May 8, 1984

[54] APPARATUS FOR HOLDING A WORK PIECE

[75] Inventor: Sol Rudy, Upland, Calif.

[73] Assignee: Alumin-Art Plating Company, Ontario, Calif.

[21] Appl. No.: 404,561

[22] Filed: Aug. 2, 1982

[51] Int. Cl.[3] ..... B25B 11/00

[52] U.S. Cl. ..... 269/46; 269/208; 269/296; 211/41; 211/117

[58] Field of Search ..... 269/46, 296, 208, 209; 118/503; 211/41, 113, 117; 248/243, 201, 297.3

[56] References Cited

U.S. PATENT DOCUMENTS

| | | | |
|---|---|---|---|
| 726,905 | 5/1903 | Gleason | 211/117 |
| 750,063 | 1/1904 | Redding | 211/117 |
| 809,490 | 1/1906 | Caporale | 248/297.3 |
| 939,508 | 11/1909 | Hull | 248/297.3 |
| 1,842,118 | 1/1932 | Resnik et al. | 211/41 |
| 2,085,969 | 7/1937 | Gedeonoff | 248/201 |
| 2,655,962 | 10/1953 | Williamson | 269/208 |
| 2,662,717 | 12/1953 | Johnson | 211/41 |
| 4,191,365 | 3/1980 | O'Neill | 269/46 |

*Primary Examiner*—Robert C. Watson

*Attorney, Agent, or Firm*—Gene W. Arant; Paul H. Ware

[57] ABSTRACT

Adjustable apparatus for firmly holding a workpiece to be treated in a fluid environment wherein the fluid may be agitated, the workpiece and its holding apparatus shaken or otherwise jostled and the whole apparatus and workpiece easily removed from one fluid environment to be placed in another for continued exposure of the workpiece to further treatment.

1 Claim, 7 Drawing Figures

APPARATUS FOR HOLDING A WORK PIECE

BACKGROUND OF THE INVENTION

This invention relates to apparatus for holding a workpiece so as to be retrieved after being submersed in liquid or other fluid bath and in particular to structure that will secure such a workpiece firmly enough so that it may be shaken or otherwise agitated in the fluid environment without becoming dislodged.

As an illustration of the applicability of the structure of the inventive device, it may be shown that it has been common practice in the plating industry to submerse a workpiece to be plated in various baths for preconditioning before plating and postconditioning afterward. In many of these baths, the workpiece and the structure securing the workpiece must be jostled, shaken or otherwise agitated so as to gain the maximum efficacy of the fluid environment. It is thus necessary to provide a structure supporting and securing a workpiece so operated upon such that the workpiece may be retrieved from the fluid bath still secured to the workpiece holder.

It would be of great advantage to the art to provide such a secure and stable apparatus for holding a workpiece to be so operated upon that would be simple to adjust to the various shapes, sizes and configurations that the workpieces may assume and that will be strong enough to hold such workpieces to prevent them from being dropped or otherwise dislodged from the support during agitation, jostling or other means of obtaining maximum efficacy from a fluid environment.

It would be of additional great value to the art to provide a structure of the type contemplated that is reusable, easy to adjust and economical.

SUMMARY OF THE INVENTION

It is a primary object of the present invention to provide a structure by means of which a workpiece to be treated may be immersed and jostled in an agitated fluid bath and may be securely held so as to be retrievable from the bath without having been dislodged from the workpiece holding structure.

In the accomplishment of this object, a holding apparatus of unique configuration is provided by means of which workpieces of various sizes and shapes may be secured without becoming dislodged therefrom under reasonable and normal operations of jostling and agitation.

DRAWING SUMMARY

Further advantages and features of the present invention will be more fully apparent to those skilled in the art to which the invention pertains from the ensuring detailed description thereof, regarded in conjunction with the accompanying drawings wherein like reference characters refer to like parts throughout and in which.

PREFERRED EMBODIMENT

Although specific preferred embodiments of the invention will now be described with reference to the drawings, it should be understood that any such embodiments are by way of example only and merely illustrative of but a small number of the many possible specific embodiments which can represent applications of the principles of the invention. Various changes and modifications, obvious to one skilled in the art to which the invention pertains, are deemed to be within the spirit, scope and contemplation of the invention as further defined in the appended claims.

Figure 1:
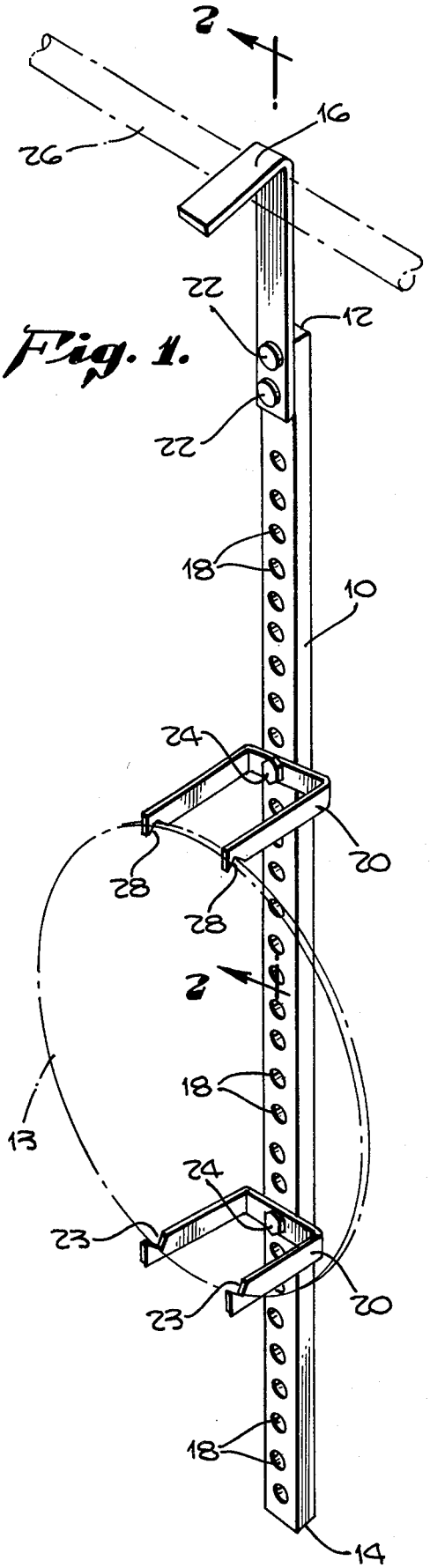
FIG. 1 is an idealized perspective schematic drawing of the inventive device, showing as a workpiece a transparent disc affixed thereto.

Referring to FIG. 1 with greater particularity, the main shaft 10 of the inventive device is shown attached to hanger 16 by means of hanger attaching means 22. Said hanger has been shown in the drawings to be in turn supported by support rod 26. Discreet adjustment location means 18 have been shown in the form of spaced holes or apertures in the main shaft 10. The purpose of these discreet adjustment location holes is to provide a means of adjustment for the positions of U-shaped workpiece holders 20 by means of adjustable workpiece holder attaching means 24 which may take the form of a conventional nut and bolt assembly. The parts of the main shaft 10 have been denoted by the numerals 12 to identify the top extremity of the main shaft and the numeral 14 to define the bottom extremity of the main shaft. This designation by no means is intended to limit the possible orientations of main shaft 10, being used only as a means of referring to one end of the main shaft as against reference to the other end. A workpiece 13 has been shown in the form of a disc and shown in phantom lines merely as an illustrative device to show how a workpiece might be secured by means of U-shaped workpiece holders 20. U-shaped workpiece holders 20 are shown with a notch 28 in each leg so as to secure the workpiece.

Figure 2:
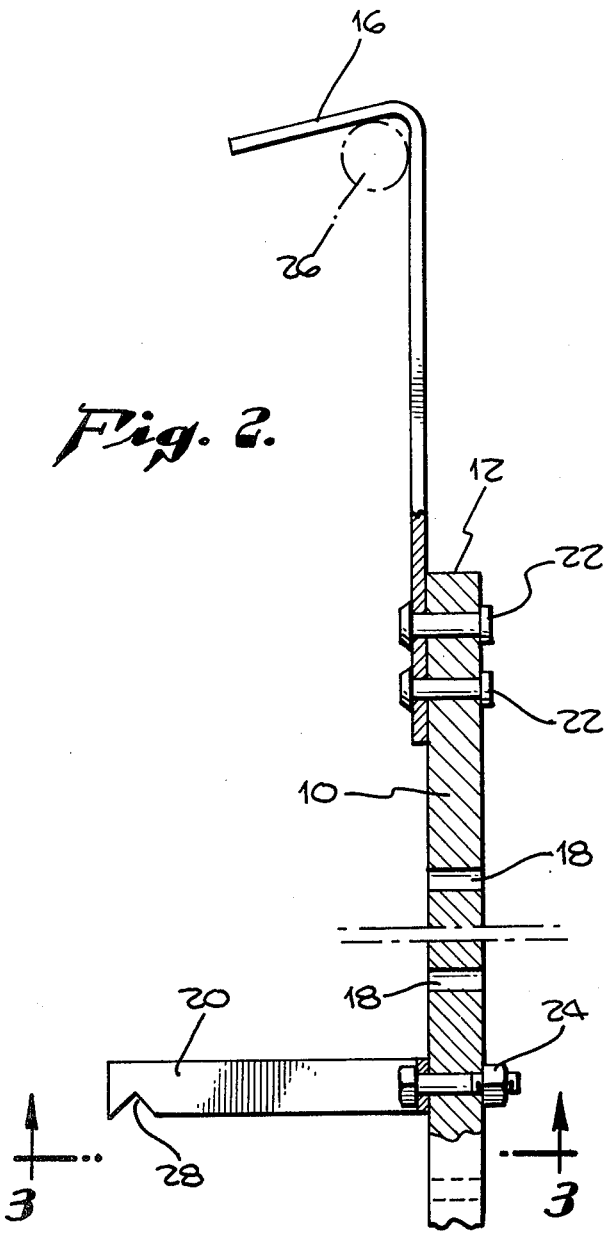
FIG. 2 is an enlargement of a profile view taken along the sight lines 2—2 of FIG. 1.

With reference to FIG. 2, it may be observed that hanger 16 has a bend formed near its upper end so as to be easily disengageable from support rod 26 so that the total device including its workpiece load may be easily removed or inserted into a bath or whatever other environment may be desired for the moment. Hanger attaching means 22 is shown in detail in FIG. 2 as rivets, however, such attachment is not intended to limit the attachment means of hanger 16 to main shaft 10.

Figure 3:
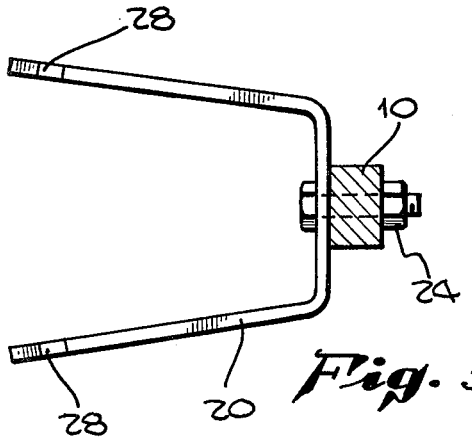
FIG. 3 is a detailed view of the U-shaped workpiece holder as viewed along the sight lines 3—3 of FIG. 2.
Figure 4:
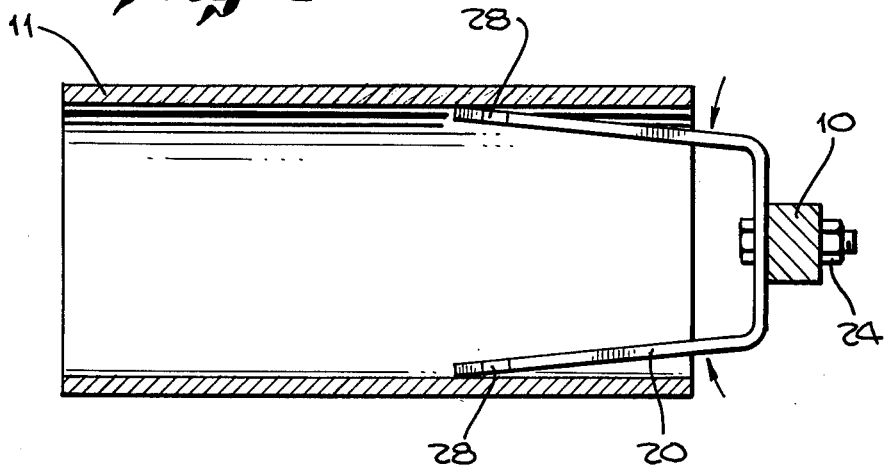
FIG. 4 is a view of the U-shaped workpiece holder as it might be employed to secure an open cylindrical workpiece.

Reference to FIG. 3 will show that the U-shaped workpiece holders are not strictly U-shaped in not having their legs perpendicular to the bottom part of the U, being more spread out so as to afford a resilience thereto. Thus if the legs of the U-shaped workpiece holder 20 are compressed so as to accept a cylindrical workpiece 11 as indicated in FIG. 4, the natural resilience or elasticity of the material of the legs performing the function of securing the workpiece to itself comes into play. It is importantly contemplated that the adjustable workpiece holder attaching means 24, in cooperation with discreet adjustment locating means 18, effect a swivel movement and almost unlimited orientation of U-shaped workpiece holders 20 so as to easily accommodate various sizes and shapes of workpieces to be treated.

Figure 5:
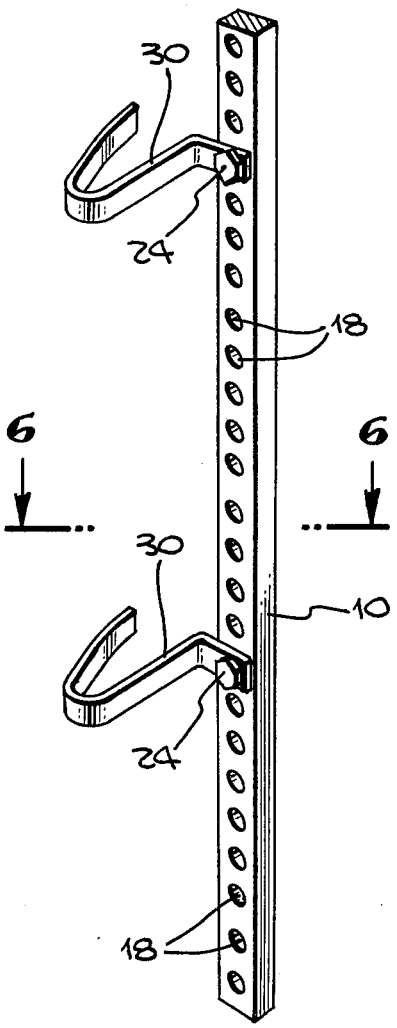
FIG. 5 is a view of an embodiment of the inventive device showing a different workpiece holder.
Figure 6:
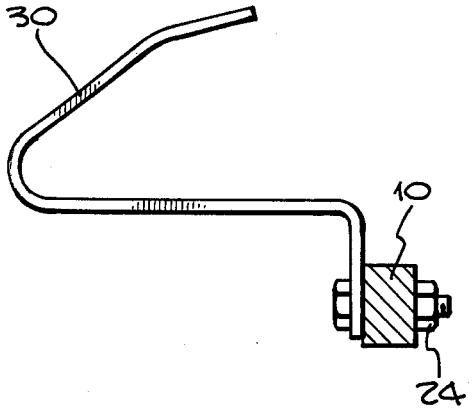
FIG. 6 is a detailed profile view of the different workpiece holder of FIG. 5 as might be viewed along the sight lines 6—6 of FIG. 5.
Figure 7:
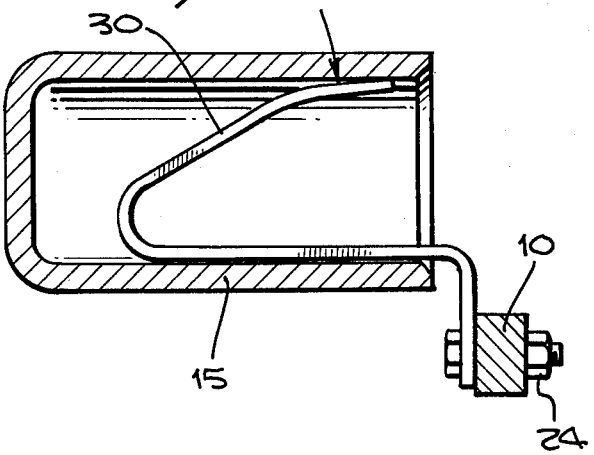
FIG. 7 is an illustration showing how the different workpiece holder detailed in FIG. 6 might be employed to secure a workpiece.

FIGS. 5, 6 and 7 illustrate an alternative kind of workpiece holding device. The operation of this device is dependent primarily on the resiliency and elasticity of the material of the workpiece holder and the shape of the workpiece to be treated.

It will be noted that one of U-shaped workpiece holders 20 may be moved and relocated in discreet steps by means of discreet adjustment location means 18 and adjustable workpiece holder attaching means 24 toward the top extremity of main shaft 10 while another U-shaped workpiece holder 20 located in opposite symmetrical relationship to that first workpiece holder may be moved toward the bottom extremity 14 of main shaft 10. Thus the workpiece holders may be coarsely adjusted initially with respect to each other so as to accommodate a larger or a smaller workpiece as the case may be, and then a final finer adjustment by means of the swivel effect may be accomplished so as to accommodate the shape of the workpiece to be treated.

A workpiece thus securely attached to this inventive device by means of the workpiece holders adjusted so as to secure said workpiece, may be placed in an agitated bath, may be jostled and moved around in a bath prior to, during or after a plating operation and may be moved from one environment to another without becoming dislodged from the holding device.

The structure so described is shown to be easy to install within a bath or other environment, merely requiring the lifting by means of hanger 16 and transporting from one place to another. Easy accessibility to the workpiece is immediately obvious, and adjustment to the size and shape of a workpiece to be operated upon is immediately apparent.

It is here pointed out that although the present invention has been shown and described with reference to a particular embodiment, nevertheless, various changes and modifications, obvious to one skilled in the art to which the invention pertains, are deemed to lie within the purview of the invention.

I claim:

1. Apparatus for holding a workpiece to be submersed in a liquid bath against jostling and shaking movement, said apparatus comprising:

a main shaft adapted to be vertically disposed having vertically spaced horizontal holes and having top and bottom extremities and a suspension hanger attached to said top extremity;

a pair of U-shaped workpiece holders having legs spread outwardly from the bottom thereof to be adjustably attached to said main shaft, each having a hole near the center of the bottom of the U and at least one hook near the end of each leg of said U formed by making a notch near the end of each leg thereof; and at least one pair of nut and bolt assemblies, each bolt of such assembly being disposed through said hole near the center of the bottom of the U of a corresponding one of said U-shaped workpiece holders and also through a selected one of said vertically spaced horizontal holes in said main shaft, and each bolt being of such smaller cross-sectional dimension than the diameter of either of said holes so as to provide a swivel movement of said U-shaped workpiece holder; whereby said pair of workpiece holders may be so positioned and oriented that the hooks thereof may grasp and retain a workpiece of unique size and configuration.

* * * * *